United States Patent [19]

Yamato et al.

[11] 4,399,188

[45] Aug. 16, 1983

[54] HEAT-SENSITIVE RECORDING SHEET

[75] Inventors: Noboru Yamato; Tosimi Satake, both of Tokyo, Japan

[73] Assignee: Jujo Paper Co., Ltd., Tokyo, Japan

[21] Appl. No.: 278,747

[22] Filed: Jun. 29, 1981

Related U.S. Application Data

[63] Continuation-in-part of Ser. No. 252,619, Apr. 9, 1981, abandoned.

[30] Foreign Application Priority Data

Apr. 10, 1980 [JP] Japan ..... 55-46195

[51] Int. Cl.[3] ..... B41M 5/18

[52] U.S. Cl. ..... 428/320.4; 282/27.5; 428/211; 428/488; 428/537; 428/913

[58] Field of Search ..... 282/27.5; 428/307, 537, 428/488, 913, 914, 195, 211, 320.4; 427/150, 151, 153

[56] References Cited

U.S. PATENT DOCUMENTS 3,871,900 3/1975 Hayashi et al. ..... 282/27.5

4,168,845 9/1979 Oeda et al. ..... 282/27.5

FOREIGN PATENT DOCUMENTS 50-16969 6/1975 Japan ..... 282/27.5

*Primary Examiner*—Bruce H. Hess

*Attorney, Agent, or Firm*—Weinstein & Sutton

[57] ABSTRACT

A heat-sensitive recording sheet containing in its color-forming layer a colorless or pale colored chromogenic fluoran-type dyestuff and p-hydroxybenzoic acid ester having the following general formula

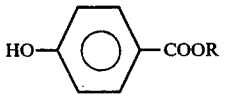

wherein R represents

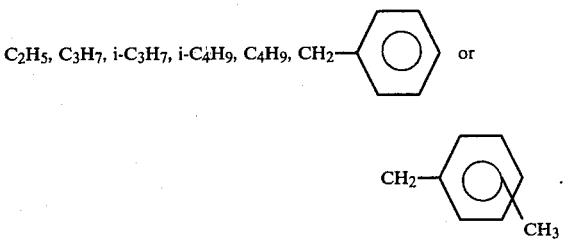

This heat-sensitive recording sheet incorporates high image density and very preferable recording aptitude with less abrasiveness and less residues accumulated even for long time recording.

Furthermore, a phenol substance having a melting point of more than 90° C. and a solubility of less than 0.1 g per 100 g water, which is used together with said p-hydroxybenzoic acid ester, is useful for lowering the yellowing of the heat-sensitive sheet.

14 Claims, No Drawings

HEAT-SENSITIVE RECORDING SHEET

REFERENCE TO OTHER APPLICATIONS

This application is a continuation-in-part of application Ser. No. 252,619, filed Apr. 9, 1981 now abandoned.

BACKGROUND OF THE INVENTION

The present invention relates to a heat-sensitive recording sheet, and more particularly, to such a heat-sensitive recording sheet having excellent color-forming properties, other recording aptitudes and stability of background brightness.

A heat-sensitive recording sheet that utilizes a heat color-forming reaction occurring between a colorless or pale-colored chromogenic dyestuff and a phenolic material, or an organic acid is disclosed, for example, in the Japanese Patent Publication Nos. 4160/1968 and 14039/1970 and in the Japanese Laid-Open patent application No. 27736/1973, and is now widely applied for practical use.

In general, a heat-sensitive recording sheet is produced by applying on the paper surface the coating which is prepared by individually grinding and dispersing a colorless chromogenic dyestuff and a color-developing material, such as a phenolic substance, into fine particles, mixing the resultant dispersions with each other and then adding thereto binder, filler, sensitizer, slipping agent and other auxiliaries. When this sheet is heated, the coating undergoes instantaneously a chemical reaction which forms a color. In this case various bright colors can be advantageously formed depending upon selection of specific colorless chromogenic dyestuff.

These heat-sensitive recording sheets have now been finding a wide range of applications, including medical or industrial measurement recording instruments, terminal printers of computer and information communication systems, facsimile equipments, printers of electronic calculators, automatic ticket vending machines, and so on.

Such recording equipment has heating elements such as a thermal head or heating pen (stylus). When heated on contact with heating elements or by energy of predetermined light, the heat-sensitive recording sheet forms a color for recording.

A thermal head is provided with minute resistors on a substrate and is ordinarily subjected to its heating and cooling cycles repeatedly at a short cyclic period of 0.5–20 milliseconds by applying an electric current, and the color-forming layer of a heat-sensitive recording paper on contact with the thermal head is melted with the heat energy owing thereto and causes a color-forming reaction for recording.

Thermal heads that have been produced so far are diverse in their materials used and configuration. Accordingly, since the requirements for heat-sensitive recording sheets vary largely with the performance, controlling method, recording conditions (impressed voltage, pulse width, surface temperature, contacting pressure, recording speed and contents of information to be recorded) or the like of the specific thermal heads used, the matching between the respective heat-sensitive recording sheets and the recording equipment is very important. Especially in recent years, as the applications of recording equipment tend to be diversified and require a higher performance, a higher quality has come to be required for heat-sensitive recording sheets to be used thereon.

In printers, e.g. a dot matrix of 5×7 array is previously sufficient to express the alphabet and numerals, but a dot matrix of 16×18 array or 32×32 array is now required for the exact expression of Chinese characters.

In facsimiles which use thermal heads brought into line, a density of circa 4 lines per mm was previously sufficient, but a density of 8 or more lines per mm is now required for the improvement of image, that is, improvement of resolution.

Normal recording velocity of printers which was previously 30–60 characters per second, has become faster and faster, and is nowadays 120 or more characters per second.

Facsimile equipment requires, nowadays, less than one minute for recording a sheet of A4-size (210 mm×297 mm), although, previously, several minutes for recording was required.

For such high speed recording, it is required to shorten heating time on applying an electric current, that is, to shorten a pulse width, which causes a reduced heat energy. In this case, it cannot be expected, due to consideration of durability of the thermal heads, to raise the temperature of the thermal heads by raising impressed voltage as a method for compensation of the reduced heat energy.

Also, the heat energy of the thermal heads in the recording equipment capable of such high density and such high speed is more minimized. Therefore, it is required that the heat-sensitive recording sheet has a higher color-forming sensitivity sufficient for producing clear chromogenic records with such small heat input from the thermal head.

Therefore, a colorless dyestuff or an acidic material, such as organic acids and phenols, in the color-forming layer must be melted with minimized heat energy to cause the color-forming reaction. If possible, it is desirable to cause the color-forming at a temperature of 70° C. to 120° C.

The colorless chromogenic dyestuffs for thermal recording sheets which have the structure of lactones, lactams, spiropyrans etc. possess usually a melting point of 160° C. to 240° C., but there are no stable dyestuffs that are melted at the aforementioned low temperature.

On the other hand, there are many color-developing agents, such as organic acids and phenolic substances, which were used in combination with a colorless chromogenic dyestuff and which were disclosed in the Japanese Patent Publication No. 14039/1970 and various literatures. Particularly, 4,4'-isopropylidendiphenol (bisphenol A, having a melting point: 156° C. to 158° C.) is a useful, desirable phenolic substance and is now widely put into practical use, since it is stable, inexpensive and readily available. But 4,4'-isopropylidendiphenol has as its disadvantage a high heat color-forming temperature.

Then, phenolic substances of low melting point, for example, monomeric phenols such as 4-tertiary-butylphenol (m.p. 94°–99° C.), α-naphthol (m.p. 95°–96° C.), β-naphthol (m.p. 119°–122° C.) etc., deteriorate preservability and stability of a heat-sensitive recording sheet, which is gradually colored at room temperature and has a phenolic odor. Therefore, such phenolic substances are not acceptable for practical use. The Japanese Patent Publication No. 12819/1979 discloses that p,p'-(1-methyl-normalhexylidene-) diphenol has a low melting point (m.p. 99°–103° C.) and gives a heat-sensitive recording paper with excellent stability and color-forming property, but there is a shortcoming that such substance has difficulty in synthesis and is not readily available.

As described hereinabove, there are almost no compounds having effective melting points for high speed and high resolution recording among colorless chromogenic dyestuffs and organic acids, such as phenols, which are possible to be used practically.

The color-forming temperature of heat-sensitive recording sheets depends upon the melting of either one of color-forming materials composed of a chromogenic dyestuff and an acidic material, such as organic acids and phenols.

Where both color-forming materials have a higher melting point, a substance with a lower melting point is added thereto. In this case, if one of the color-forming materials is dissolved by melting this substance, it is possible to cause a color-forming reaction even at a lower temperature. Also, the Japanese Laid-Open Patent Applications Nos. 39139/1978, 26139/1978, 5636/1978, 11036/1978, etc. have proposed to add the following heat-meltable substances of a lower melting point as sensitizers or melting-point-depression-agents: various waxes, fatty acid amides, alkylated biphenyls, substituted biphenylalkanes, cumarin compounds, diphenylamines, etc.

In the method for addition of sensitizer, it is required to melt the sensitizer prior to the color-forming reaction, so that the thermal response for a slight amount of heat energy in short time-pulse cannot be obtained satisfactorily in the high speed dynamic recording. The following problems occur due to the liquidation of the meltable substance in the color-forming layer: adhesion of residues onto the thermal head, bleeding, smearing, ghost, etc. In this case, under storage conditions at high temperature and at high humidity, the coloring of the background occurs with the time elapsed and the contrast of the recording image may be often degraded.

In accordance with the heating and the cooling cycle of the thermal head in the thermal recording process, the color-forming materials contained in the color-forming layer of a heat-sensitive recording sheet are once heat-melted and solidified, wherein a portion of the color-forming materials adhere to the surface of the thermal head, and consequently the melted heat-sensitive materials may be accumulated on the head surface as "residues", so that the quality of the recorded image is lowered.

Furthermore, if the thermal head adheres or sticks to the heat-sensitive sheet, that is, if a so-called "sticking" occurs, the movement of the sheet or the head will be obstructed with generation of offensive sounds and, in the worst case, the recording function itself may become impossible.

In order to resolve the above-mentioned problems, the Japanese Laid-Open Patent Applications Nos. 2793/1972, 33832/1973, 30539/1975, 145228/1977, 118846/1979, 118847/1979, etc. disclose the following methods: (1) the addition of filler such as clays, kaolin, talc, calcium carbonate, titanium dioxide, magnesium hydroxide, magnesium carbonate, etc. into the color-forming layer, (2) the increased addition of binder into the color-developing layer, or (3) the addition of waxes, releasing agent, starch particles, pulp-powder, coarse inorganic pigments, etc., into the color-forming layer. But these methods do not produce sufficient effects, and cause the increased amount of coating, the lowering of image density and the increased adhesiveness to the thermal head. Also sufficient results are not always obtained by these methods.

SUMMARY OF THE INVENTION

An object of the present invention is to provide a heat-sensitive sheet which has high sensitivity without sensitizer or melting-point-depression-agent, and produces particularly intense, clear image in high speed and high density recording owing to excellent thermal response.

It is the second object of the present invention to provide a heat-sensitive recording sheet which has no accumulated residues, no sticking, and a superior recording aptitude.

It is the third object of the present invention to provide a heat-sensitive recording sheet which has high brightness and less decline of brightness in the time elapsed.

It is the fourth object of the present invention to provide a heat-sensitive recording sheet which is an excellent thermal copying paper for infrared type or strobo-flash type thermal copy-machines, in coating thin paper or film.

It is the fifth object of the present invention to provide a heat-sensitive recording sheet in which decreased amount of coating is possible and production efficiency is increased.

It is the sixth object of the present invention to provide a heat-sensitive recording sheet which has various sensitivities by the choice of p-hydroxybenzoic acid esters (m.p. approximately 60°–120° C.) used in the present invention.

It is the seventh object of the present invention to provide a heat-sensitive recording sheet which has excellent yellow-resistance by using a phenol with a melting point of more than 90° C. and a solubility of less than 0.1 g per 100 g water together with the p-hydroxybenzoic acid ester.

The above and other related objects can be performed by using with the colorless or paled colored fluoran-type dyestuff, color-developing agents comprising p-hydroxybenzoic acid esters of the general formula

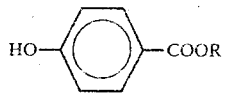

wherein R represents

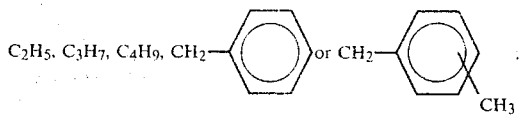

p-hydroxybenzoic acid esters used in the present invention have no phenolic odor of monomeric phenols, have high safety due to less toxicity and are synthesized easily with high yield and high purity. Many of them can be put on the market as commercial products and are inexpensive.

DETAILED DESCRIPTION p-hydroxybenzoic acid esters which are usually synthesized from p-hydroxybenzoic acid and various alcohols, are white crystals and insoluble in water. They are used mainly as preservatives and fungicides for medicines, cosmetics and industrial chemicals. Particularly, the ethyl ester, propyl ester, butyl ester of p-hydroxybenzoic acid are excellent in safety, and are approved as food-additives.

Examples of p-hydroxybenzoic acid esters used in the present invention are listed in Table 1 as follows:

TABLE 1

| Compound | —R | Melting point |
|---|---|---|
| p-Hydroxybenzoic acid ethyl ester | $—C_2H_5$ | 116–118° C. |
| p-Hydroxybenzoic acid propyl ester | $—C_3H_7$ | 95–98° C. |
| p-Hydroxybenzoic acid isopropyl ester | -iso $C_3H_7$ | 84–85° C. |
| p-Hydroxybenzoic acid butyl ester | $—C_4H_9$ | 69–72° C. |
| p-Hydroxybenzoic acid isobutyl ester | -iso $C_4H_9$ | 75–77° C. |
| p-Hydroxybenzoic acid benzyl ester | $—CH_2—C_6H_5$ | 108–113° C. |
| p-Hydroxybenzoic acid methylbenzyl ester | $—CH_2—C_6H_4—m-CH_3$ | 95–98° C. |

As the substances having a similar structure to the above-mentioned compounds of the present invention, the Japanese Patent Publication No. 14039/1970 discloses methyl-4-hydroxybenzoate having a melting point of 125°–128° C., and the Japanese Patent Publication No. 35095/1979 discloses phenyl-4-hydroxybenzoate having a melting point of 150°–158° C.

The both compounds are unsuitable to the object of the present invention, since they require high color-forming temperature due to high melting points. The Japanese Patent Publication 16969/1975 discloses that p-hydroxybenzoic acid esters or o-hydroxybenzoic acid esters which have alkyl groups of 2–18 carbon atoms are used in a pressure-sensitive recording paper. Most of these compounds are liquid at room temperature, while some other of these compounds are solid. In this case, the solid compounds were used in a pressure-sensitive paper after they were dissolved in an organic solvent. Thus, such compounds are different from the present invention in the form used and the effect.

p-Hydroxybenzoic acid esters of the present invention may be employed as the color-developing agent of a heat-sensitive recording sheet singly or together with phenols as color-developing agent, such as p-tertiary butylphenol, p-phenylphenol, Novolak phenolic resin, and the like.

In this case, the resistance to yellowing after storing in a room for a long time is not satisfactory.

The inventors have been researching and studying its improvement, and finally found that a heat-sensitive recording sheet with practically excellent yellowing-resistance may be obtained by adding a particular phenol substance to the color-forming layer containing the p-hydroxybenzoic acid ester.

The phenolic substance as yellowing-resistance agent, which is used together with p-hydroxybenzoic acid ester, includes phenols which have a melting point of more than 90° C. and a solubility of less than 0.1 g per 100 g water, and do not have a color forming ability in the presence of the colorless or pale colored fluoran-type dyestuff.

Phenols with a melting point of less than 90° C. are not suitable for practical use, since they are sublimable and unstable in other properties and they lower production efficiency due to a required dryer-temperature of less than 90° C. after their coating.

Further, phenols with a solubility of more than 0.1 g per 100 g water may decrease the advantageous whiteness of background in the use of p-hydroxybenzoic acid esters as color-developing agent.

It is desirable that phenols having a melting point of more than 90° C. and a solubility of less than 0.1 g per 100 g water have a specific gravity of 0.9–1.15, taking an appropriate coating into consideration. Phenols with a specific gravity of more than 1.15 precipitate in coating colors even when they are ground to fine particles in aqueous solution. On the other hand, phenols with a specific gravity of less than 0.9 float on the surface of coating colores. Examples of the phenolic substance as yellowing-resistance agent includes 4,4'-butylidene-bis(3-methyl-6-tertiary-butylphenol), 2,2'-methylene-bis(4-ethyl-6-tertiary-butylphenol), 2,5-di-tertiary-butylhydroquinone, 2,5-di-tertiary-amylhydroquinone, 1,1'-bis(4-hydroxyphenyl)-cyclohexane, 2,6-bis(2'-hydroxy-3'-tertiary-butyl-5-methylbenzyl)-4-methylphenol, 2,2'-methylene-bis(4-ethyl-6-tertiary-butylphenol), 2,2'-iso-butylidene-bis(4,6-di-methylphenol), 1'-oxy-3-methyl-4-iso-propylbenzene, 2-hydroxy-4-benzyloxy-benzophenone, bis-[3,3'-bis-(4'-hydroxy-3'-tertiary-butylphenol)-butyric acid] glycol ester, bis(3-methyl-4-hydroxy-5-tertiary-butyl-benzyl) sulfide, 2,2'-methylene-bis(4-methyl-6-cyclohexyl-phenol) and hydroquinone-mono-benzyl ether.

The above-mentioned phenols are different from the phenols used as color-developing agent and are particularly employed for lowering the yellowing of background in use of p-hydroxybenzoic acid ester as color-developing agent, which can be used together with the aforementioned phenols as a color-developing agent.

The colorless or pale colored dyestuffs of the present invention are fluoran-type dyestuffs. Triphenylmethanephthalide-type dyestuffs such as crystal violet lactone, rhodamine-type dyestuffs, spiropyran-type dyestuffs and leucoauramine-type dyestuffs may be colored in the presence of p-hydroxybenzoic acid ester in heating, but are unsuitable for heat-sensitive recording sheets due to the tendency of discoloration in elapsed time.

The colorless or pale colored dyestuffs of the present invention are not particularly limited and are, for example, as follows: 3-diethylamino-6-methyl-7-anilinofluoran (black), 3-(n-ethyl-p-toluidino)-6-methyl-7-anilinofluoran (black), 3-diethylamino-6-methyl-7-(o, p-dimethylanilino) flouran (black), 3-pyrrolidino-6-methyl-7-anilinofluoran (black), 3-piperidino-6-methyl-7-anilinofluoran (black), 3-(N-cyclohexyl-N-methylamino)-6-methyl-7-anilinofluoran (black), 3-diethylamino-7-(o-chloroanilino) fluoran (black), 3-diethylamino-7-(m-trifluoromethylanilino) fluoran (black), 3-diethylamino-6-methylchlorofluoran (red), 3-diethylamino-6-methylfluoran (red), 3-cyclohexylamino-6-chlorofluoran (orange).

The aforementioned color-developing materials and colorless chromogenic dyestuffs are ground down to a particle size of several microns or smaller by means of a grinder or emulsifier such as ball mill, attritor, sand grinder, etc. and in accordance with the purpose, various additives are added thereto to prepare coating colors. Such additives are as follows: binders such as polyvinyl alcohol, hydroxyethyl cellulose, methyl cellulose, starches, styrene-maleic anhydride copolymer, vinylacetate-maleic anhydride-copolymer, styrene-butadiene-copolymer, etc.; inorganic or organic fillers such as kaolin, calcined kaolin, diatomaceous earth, talc, titanium dioxide, calcium carbonate, magnesium carbonate, aluminium hydroxide, etc.; if desired, releasing agent such as metal salts of fatty acids, etc.; slipping agents such as waxes, etc.; UV-absorbers of benzophenone type or triazole type; water-resistance-agents such as glyoxal, etc.; dispersants; antifoamers; etc.

The heat-sensitive recording sheet suitable for the purpose can be obtained by applying paper or various films with these coating colors.

The species and the amount of p-hydroxybenzoic acid ester and the amount of other ingredients to be incorporated in accordance with the present invention are not otherwise limited, but determined depending upon the performance and recording aptitude required for the specific heat-sensitive recording sheet. However, in ordinary cases, it is suitable to use 3–10 parts by weight of p-hydroxybenzoic acid ester, 1–5 parts by weight of phenolic substance as yellowing-resistance agent and 1–20 parts by weight of filler per 1 part by weight of a chromogenic fluoran-type dyestuff, and to add 10–20% by weight of a binder per total solid content.

Hereinafter, the present invention will be described further by typical exemplary formulations of the preferred embodiments thereof and by reference examples.

EXAMPLE 1

| | |
|---|---|
| Solution A (dispersion of dyestuff) | |
| 3-diethylamino-6-methyl-7-anilinofluoran | 2.0 parts |
| 10% aqueous solution of polyvinyl alcohol | 4.6 parts |
| water | 2.5 parts |
| Solution B (dispersion of color-developing agent) | |

-continued

| | |
|---|---|
| color-developing agent *(see Table 2) | 6.0 parts |
| zinc stearate | 0.5 parts |
| 10% aqueous solution of polyvinyl alcohol | 30 parts |

*As color-developing agent, there were used bisphenol A and p-hydroxybenzoic acid esters, HO— 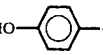 —COOR, in which R is taken as shown in Table 2.

The solutions A and B of the above-mentioned composition were individually ground to a particle size of 3 microns by a ball mill. Then, the dispersions were mixed in the following proportion to prepare the coating colors:

| | |
|---|---|
| Solution A (dispersion of dyestuff) | 9.1 parts |
| Solution B (dispersion of color-developing agent) | 36.5 parts |
| Kaolin clay (50% aqueous dispersion) | 12 parts |

The coating colors were applied on one side of the base paper weighing 50 g/m$^2$ at a coating weight of 6.0 g/m$^2$, and were then dried.

The resultant sheets were treated to a smoothness of 200–300 sec. by a supercalender.

The obtained black-color-forming heat-sensitive recording sheets were tested for their quality and performance, and the test results are shown in Table 2.

TABLE 2

| | | Color developing agent | Background (1) Immediately | Background (1) After a week | Image density (2) Static | Image density (3) Dynamic | Sticking (4) |
|---|---|---|---|---|---|---|---|
| Example | 1-a | $-C_2H_5$ as R | 0.05 | 0.05 | 1.05 | 1.15 | No trouble |
| | 1-b | $-C_3H_7$ as R | 0.05 | 0.05 | 1.09 | 1.13 | No trouble |
| | 1-c | -iso $C_3H_7$ as R | 0.08 | 0.09 | 1.08 | 1.15 | No trouble |
| | 1-d | $-nC_4H_9$ as R | 0.07 | 0.07 | 1.20 | 1.15 | No trouble |
| | 1-e | -iso $C_4H_9$ as R | 0.07 | 0.07 | 1.18 | 1.15 | No trouble |
| | 1-f | $-CH_2-C_6H_5$ as R | 0.05 | 0.05 | 1.18 | 1.20 | No trouble |
| | 1-g | 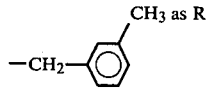 | 0.05 | 0.06 | 1.18 | 1.20 | No trouble |
| Reference example | 1-a | Bisphenol A | 0.08 | 0.12 | 0.28 | 0.81 | White spots in image Noise in recording |
| | 1-b | $-CH_3$ as R | 0.06 | 0.07 | 1.04 | 1.00 | No white spots in image but noise in recording |
| | 1-c | $-C_6H_5$ as R | 0.06 | 0.07 | 0.45 | 0.76 | White spots in image Noise in recording |

Notes:
(1) Optical density of background was measured by a Macbeth densitometer RD-514 (lower optical density shows higher brightness).
(2) The heat-sensitive recording sheets were pressed down for 5 seconds under pressure of 10 g/cm$^2$ on a hot plate heated at 105° C. and optical density of statically developed image was measured by a Macbeth densitometer RD-514 (higher optical density shows darker color).
(3) The heat-sensitive recording sheets were recorded in a pulse width of 3.0 milliseconds and an impressed voltage of 18.0 volt by using the thermal facsimile KB-4800 manufactured by TOSHIBA CORPORATION and optical density of recorded image was measured by a Macbeth densitometer RD-104.
(4) All-mark print was recorded by using a thermal facsimile KB-500 manufactured by TOSHIBA CORPORATION, then recording aptitude sticking, noise etc. and quality of recorded image are checked.

As obviously seen from Table 2, the heat-sensitive recording sheets 1-a–1-g of the Example according to the present invention provide higher brightness of background and less decline of brightness in elapsed time, as compared with the Reference example 1-a and have higher image density, particularly higher dynamic image density in the recording by facsimile, and scarcely any white spot, as compared with each Reference example.

EXAMPLE 2

| | |
|---|---|
| Solution A (Dispersion of dyestuff) | |
| 3-pyrrolidino-6-methyl-7-anilinofluoran | 2.0 parts |
| 10% aqueous solution of hydroxyethylcellulose | 4.6 parts |
| water | 2.5 parts |
| Solution B(1) (Dispersion of color-developing agent) | |
| p-hydroxybenzoic acid benzyl ester | 6.0 parts |
| zinc stearate | 0.5 parts |
| 10% aqueous solution of polyvinyl alcohol | 30 parts |
| Solution B(2) (Dispersion of color-developing agent) | |
| bisphenol A | 6.0 parts |
| stearic acid amide | 3.0 parts |
| 10% aqueous solution of polyvinyl alcohol | 40 parts |

Each above-mentioned solution was individually ground to a particle size of 3 microns by means of an attritor, and the dispersions were mixed in the hereinafter mentioned proportion to prepare coating colors. Heat-sensitive recording sheets were obtained as in Example 1.

| | | Example 2 | Reference example 2 |
|---|---|---|---|
| Coating color | Solution A | 9.1 parts | 9.1 parts |
| | Solution B | (1) 36.5 parts | (2) 49.0 parts |
| | Calcined kaolin (50% aqueous dispersion) | 10 parts | 10 parts |
| Coating weight | | 5.0 g/m$^2$ | 5.8 g/m$^2$ |

The resultant black-color-forming heat-sensitive recording sheets were tested for their quality and performance as in Example 1, and the test results are shown in Table 3.

TABLE 3

| | Background | | | | |
|---|---|---|---|---|---|
| | Immediately | (1) Storage at high temperature | Static image density | (2) Dynamic image density | Sticking |
| Example 2 | 0.05 | 0.07 | 1.30 | 0.90 | No trouble |
| Reference example 2 | 0.08 | 0.14 | 1.35 | 0.28 | White spots in image. Noise in recording |

Notes:
(1) The heat-sensitive recording sheets were treated for 24 hours under 40° C. and 90% R.H., and the optical density of background was measured by a Macbeth densitometer RD-104.
(2) The heat-sensitive recording sheets were recroded by using a thermal facsimile (FR-H type) manufactured by "Matsushita Graphic Communication Systems, Inc., with a pulse width of 1.0 milli-sec. and an impressed voltage of 17.66V, and the recorded image density was measured by a Macbeth densitometer RD-104.

As obviously seen from Table 3, Example 2 of the present invention provided higher brightness of background and more excellent preservability under high humidity in comparison with the Reference Example 2 using a combination of bisphenol A and sensitizer.

The heat-sensitive sheet of the present invention has as its advantage clearer image and remarkably higher image density under high speed recording by facsimile in comparison with the Reference Example 2, although under static color-forming condition using sufficient heat energy the former provides a circa same image density as the latter.

Furthermore, the present invention provides superior aptitude, for example, very less sticking.

EXAMPLE 3

| | |
|---|---|
| Solution A (dispersion of dyestuff) | |
| 3-diethylamino-6-methyl-7-(o,p-dimethylanilino) fluoran | 1.8 parts |
| 10% aqueous solution of hydroxyethyl cellulose | 4.6 parts |
| water | 2.5 parts |
| Solution B(1) (dispersion of color-developing agent) | |
| p-hydroxybenzoic acid butyl ester | 6.0 parts |
| 10% aqueous solution of polyvinyl alcohol | 30 parts |
| Solution B(2) (dispersion of color-developing agent) | |
| bisphenol A | 6.0 parts |
| stearic acid amide | 5.0 parts |
| 10% aqueous solution of polyvinyl alcohol | 30 parts |

Each solution of the above-mentioned composition was individually ground to a particle size of 2 microns by means of a sand grinder, and the dispersions were mixed in the hereinaftermentioned proportion to prepare heat-sensitive coating colors. The resultant coating colors were applied on a tissue paper weighing 30 g/m$^2$. Thereafter, heat-sensitive recording sheets were prepared by treating as in Example 1.

| | | Example 3 | Reference Example 3 |
|---|---|---|---|
| Coating color | Solution A | 8.9 parts | 8.9 parts |
| | Solution B | (1) 36 parts | (2) 41 parts |
| Coating weight | | 4.0 g/m$^2$ | 5.8 g/m$^2$ |

The resultant black-color-forming heat-sensitive sheets were tested for their quality with regard to brightness of background and static image density. And printed masters were copied on the heat-sensitive sheets by means of a strobo-flash type thermal copying machine "Xenofax FX-150", manufactured by RISOKAGAKU CO., LTD. and the image densities were measured by a Macbeth densitometer.

The test results are shown in Table 4.

TABLE 4

| | Background | Static image density | Copied image density |
|---|---|---|---|
| Example 3 | 0.07 | 1.20 | 0.95 |
| Reference Example 3 | 0.13 | 1.30 | 0.40 |

Although Example 3 of the present invention provided higher brightness of background, and lower image density under static color-forming condition using a sufficient amount of heat energy in comparison with Reference Example 3 using the combination of bisphenol A and sensitizer, it provided nevertheless so excellent responsibility for small amount of heat energy generated by instantaneous radiation of ultrared-ray, that is provided clear copied image with high density and slight bleeding.

EXAMPLE 4

| | |
|---|---|
| Solution A (dispersion of dyestuff) | |
| 3-diethylamino-6-methyl-7-anilinofluoran | 2.0 parts |
| 10% aqueous solution of polyvinyl alcohol | 4.6 parts |
| water | 2.5 parts |
| Solution B(1) (dispersion of color-developing agent) | |
| p-hydroxybenzoic acid ethyl ester | 5.0 parts |
| zinc stearate | 0.5 parts |
| 10% aqueous solution of polyvinyl alcohol | 30 parts |
| Solution B(2) (dispersion of color-developing agent) | |

-continued

| | |
|---|---|
| p-hydroxybenzoic acid benzyl ester | 5.0 parts |
| zinc stearate | 0.5 part |
| 10% aqueous solution of polyvinyl alcohol | 30 parts |
| Solution C (dispersion of yellowing-resistance agent) | |
| yellowing-resistance agent (see Tables 5 and 6) | 1.0 part |
| 10% aqueous solution of polyvinyl alcohol | 4.0 parts |

The solutions A, B(1), B(2) and C of the above-mentioned composition were individually ground to a particle size of 3 microns by a ball mill. Then, the dispersions were mixed in the following proportion to prepare the coating colors.

The coating colors were applied on one side of the base paper weighing 50 g/m$^2$ at a coating weight of 6.0 g/m$^2$, and were then dried.

TABLE 5

| Yellowing-resistance agent | Solubility in water | Melting point | Specific gravity |
|---|---|---|---|
| 2,5-di-tertiary-butylhydroquinone | 0.03 g/100 g | 200° C. | 1.11 |
| 2,5-di-tertiary-amyl-hydroquinone | 0.02 g/100 g | 172° C. | 1.02–1.08 |
| 4,4'-butylidene-bis(3-methyl-6-tertiary-butylphenol) | 0.01 g/100 g | 209° C. | 1.04–1.09 |
| 4,4'-methylene-bis(2,6-di-tertiary-butylphenol) | 0.01 g/100 g | 154° C. | 0.99 |
| 2,2'-methylene-bis(4-ethyl-6-tertiary-butylphenol) | 0.02 g/100 g | 119–125° C. | 1.11 |
| 2,2'-methylene-bis(4-methyl-6-cyclo-hexylphenol) | 0.02 g/100 g | 118° C. | 1.08 |

TABLE 6

| Example | Color-developing agent | Phenolic substance as yellowing-resistance agent | Back-ground | Image density | Yellowing-resistance |
|---|---|---|---|---|---|
| 4 (a) | p-hydroxybenzoic acid ethyl ester | — | 0.06 | 1.10 | 0.14 |
| 4 (b) | p-hydroxybenzoic acid ethyl ester | 2,5-di-tertiary-butylhydroquinone | 0.06 | 1.11 | 0.09 |
| 4 (c) | p-hydroxybenzoic acid ethyl ester | 2,5-di-tertiary-amylhydroquinone | 0.06 | 1.10 | 0.09 |
| 4 (d) | p-hydroxybenzoic acid ethyl ester | 4,4'-butylidene-bis(3-methyl-6-tertiary-butylphenol) | 0.07 | 1.11 | 0.07 |
| 4 (e) | p-hydroxybenzoic acid ethyl ester | 4,4'-methylene-bis(2,6-di-tertiary-butylphenol) | 0.05 | 1.12 | 0.09 |
| 4 (f) | p-hydroxybenzoic acid ethyl ester | 2,2'-methylene-bis(4-ethyl-6-tertiary-butylphenol) | 0.07 | 1.11 | 0.10 |
| 4 (g) | p-hydroxybenzoic acid ethyl ester | 2,2'-methylene-bis(4-methyl-6-cyclohexylphenol) | 0.08 | 1.10 | 0.09 |
| 4 (h) | p-hydroxybenzoic acid benzyl ester | — | 0.06 | 1.18 | 0.15 |
| 4 (i) | p-hydroxybenzoic acid benzyl ester | 2,5-di-tertiary-butylhydroquinone | 0.06 | 1.19 | 0.08 |
| 4 (j) | p-hydroxybenzoic acid benzyl ester | 2,5-di-tertiary-amylhydroquinone | 0.06 | 1.20 | 0.08 |
| 4 (k) | p-hydroxybenzoic acid benzyl ester | 4,4'-butylidene-bis(3-methyl-6-tertiary-butylphenol) | 0.06 | 1.21 | 0.06 |
| 4 (l) | p-hydroxybenzoic acid benzyl ester | 4,4'-methylene-bis(2,6-di-tertiary-butylphenol) | 0.06 | 1.21 | 0.08 |
| 4 (m) | p-hydroxybenzoic acid benzyl ester | 2,2'-methylene-bis(4-ethyl-6-tertiary-butylphenol) | 0.06 | 1.21 | 0.09 |
| 4 (n) | p-hydroxybenzoic acid benzyl ester | 2,2'-methylene-bis(4-methyl-6-cyclohexylphenol) | 0.07 | 1:19 | 0.08 |

Notes:

(1) Background: Optical density of background was measured by a Macbeth densitometer RD-104 (using amber filter)

(2) Image density: The heat-sensitive recording sheets were recorded in a pulse width of 3.2 milliseconds and an impressed voltage of 18.0 volts by using the thermal facsimile KB-4800 manufactured by TOSHIBA CORPORATION and optical density of recorded image was measured by a Macbeth densitometer RD-104.

(3) Yellowing-resistance: The heat-sensitive recording sheets were stored in room for a month and white portions on the sheets were measured by a Macbeth densitometer RD-104 (using blue filter).

| | Examples 4(b) to 4(g) and | 4(i) to 4(n) | Ex. 4(a) and 4(h) |
|---|---|---|---|
| Coating color | Solution A | 9.1 parts | 9.1 parts |
| | Solution B(1) or B(2) | 57.5 parts | 57.5 parts |
| | Solution C | 5.0 parts | 0 |
| | Kaolin clay (50% aqueous dispersion) | 12 parts | 12 parts |

The resultant sheets were treated to a smoothness of 200–300 see. by a supercalender.

The obtained black-color-forming heat-sensitive recording sheets were tested for their quality and performance, and the test results are shown in Table 6.

As seen from Table 6, the heat sensitive recording sheets containing a phenolic substance as yellowing-resistance agent provided excellent yellowing-resistance in comparison with the sheets without yellowing-resistance agent, although the former provided the same brightness of background and the same image density as the latter.

Furthermore, 4,4'-butylidene-bis(3-methyl-6-tertiary-butylphenol) showed the most excellent effectiveness in yellowing-resistance among the phenols as yellowing-resistance agent.

EXAMPLE 5

| | |
|---|---|
| Solution A(1) (dispersion of dyestuff) | |
| 3-(N—cyclohexyl-N—methylamino)-6-methyl-7-anilinofluoran | 1.2 parts |
| 10% aqueous solution of polyvinyl alcohol | 4.6 parts |
| water | 2.5 parts |
| Solution A(2) | |
| crystal violet lactone | 1.2 parts |
| 10% aqueous solution of polyvinyl alcohol | 4.6 parts |
| water | 2.5 parts |
| Solution B (dispersion of color-developing agent) | |
| p-hydroxybenzoic acid benzyl ester | 1 part |
| p-phenylphenol | 5 parts |
| 10% aqueous solution of polyvinyl alcohol | 25 parts |
| Solution C (dispersion of yellowing-resistance agent) | |
| 4,4'-butylidene-bis (3-methyl-6-tertiary-butylphenol) | 1.0 part |
| 10% aqueous solution of polyvinyl alcohol | 4.0 parts |

The solutions A(1), A(2), B and C of the above-mentioned composition were individually ground to a particle size of 3 microns by a ball mill. Then, the dispersions were mixed in the following proportions to prepare the coating colors:

| | | Example 5(a) | Example 5(b) | Reference Example 5 |
|---|---|---|---|---|
| Coating colors | Solution A(1) | 8.3 parts | 8.3 parts | 0 |
| | Solution A(2) | 0 | 0 | 8.3 parts |
| | Solution B | 31.0 parts | 31.0 parts | 31.0 parts |
| | Solution C | 5.0 parts | 0 | 0 |
| | Aluminium hydroxide (50% aqueous dispersion) | 15 parts | 15 parts | 15 parts |
| Coating weight | | 6.0 g/m$^2$ | 6.0 g/m$^2$ | 6.0 g/m$^2$ |

The obtained black-color-forming heat-sensitive recording sheets were tested for their quality and performance as in Example 4, and the test results are shown in Table 7.

TABLE 7

| | Background | Image density immediately | Image density one month later | Yellowing-resistance |
|---|---|---|---|---|
| Example 5(a) | 0.06 | 1.24 | 1.22 | 0.07 |
| Example 5(b) | 0.07 | 1.22 | 1.20 | 0.12 |
| Reference Example 5 | 0.06 | 1.22 | 0.20 | 0.10 |

As seen from Table 7, the heat-sensitive recording sheet as Example 5(a) containing a phenolic substance as yellowing-resistance agent provided excellent yellowing-resistance in comparison with the sheet of Example 5(b) without yellowing-resistance agent, although the former provided the same brightness of background and the same image density as the latter.

In the heat-sensitive recording sheet of Reference Example 5 using crystal violet lactone, good image density which had been obtained immediately after a recording was almost lost for a month. On the other hand, the sheets of Examples 5(a) and 5(b) maintained a stable recording image after a month.

What is claimed is:

1. A heat-sensitive recording sheet having a microcapsule-free color forming layer comprising a colorless or pale-colored chromogenic fluoran type dyestuff and a color-developing agent causes color development only at an elevated temperature, said color-developing agent comprising a p-hydroxybenzoic acid ester having the following general formula

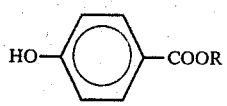

wherein R represents $C_2H_5$, $C_3H_7$, i-$C_3H_7$, $C_4H_9$, i-$C_4H_9$, $CH_2$— 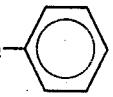 or

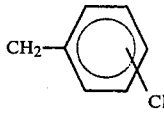

2. The heat-sensitive recording sheet according to claim 1, wherein said color-developing agent contains a phenolic substance, which resists yellowing, having a melting point of more than 90 degrees C, a solubility of less than 0.1 g per 100 g water, a specific gravity of 0.9–1.15, and has no color-developing ability in the presence of said fluoran-type color-formers, in addition to said p-hydroxybenzoic acid ester.

3. The heat-sensitive recording sheet according to claim 2, wherein said phenolic substance is 4,4'-butylidene-bis(3-methyl-6-tertiary-butylphenol).

4. The heat-sensitive recording sheet according to claim 2, wherein said phenolic substance is at least one substance selected from the group consisting of 2,2'-methylene-bis(4-methyl-6-tertiary-butylphenol), 2,5-di-tertiary-butyl-hydroquinone, 2,5-di-tertiary-amyl-hydroquinone, 1,1'-bis(4-hydroxy-phenyl) cyclohexane, 2,6-bis(2'-hydroxy-3'-tertiary-butyl-5-methylbenzyl)-4-methylphenol, 2,2'-methylene-bis(4-ethyl-6-tertiary-butylphenol), 2,2'isobutylidene-bis(4,6-dimethyl-phenol), 1'-oxy-3-methyl-4-isopropylbenzene, 2-hydroxy-4-benzyloxy-benzophenone, bis-[3,3'-bis(4'-hydroxy-3'-tertiary-butylphenol)-butyric acid]glycol ester, bis(3-methyl-4-hydroxy-5-tertiary-butyl-benzyl) sulfide, 2,2'-methylene-bis(4-methyl-6-cyclohexyl-phenol) and hydroquinone-mono-benzylether.

5. The heat-sensitive recording sheet according to claim 2, wherein said color-forming layer comprises 1 part by weight of said colorless or pale-colored chromogenic fluoran type dyestuff, from about 3 to about 10 parts by weight of said p-hydroxybenzoic acid ester, from about 1 to about 5 parts by weight of said phenolic substance as a yellowing resistance agent, from about 1 to about 20 parts by weight of filler per 1 part by weight of chromogenic dyestuff, and from about 10 to about 20 parts by weight of a binder in total solid content.

6. The heat-sensitive recording sheet according to claim 1, wherein said colorless, or pale colored, fluoran-type, dyestuff is at least one substance selected from the group consisting of 3-diethylamino-6-methyl-7-anilino-fluoran, 3-(n-ethyl-p-toluidino)-6-methyl-7-anilinofluoran, 3-diethyl-amino-6-methyl-7-(o,p-dimethylanilino)-fluoran, 3-pyrrolidino-6-methyl-7-anilinofluoran, 3-piperidino-6-methyl-7-anilino-fluoran, 3-(N-cyclohexyl- N-methylamino)-6-methyl-7-anilino-fluoran, 3-diethylamino-7-(o-chloroanilino) fluoran, 3-diethylamino-7-(m-trifluoromethylanilino) fluoran, 3-diethylamino-6-methylchlorofluoran 3-diethylamino-6-methylfluoran, and 3-cyclohexylamino-6-chlorofluoran.

7. The heat-sensitive recording sheet according to claim 1, wherein said chromogenic dyestuff is 3-diethylamino-6-methyl-7-anilinofluoran.

8. The heat-sensitive recording sheet according to claim 1, wherein said chromogenic dyestuff is 3-pyrrolidino-6-methyl-7-anilinofluoran and said color developing agent is p-hydroxy-benzoic acid benzyl ester.

9. The heat-sensitive recording sheet according to claim 1, wherein said chromogenic dyestuff is 3-diethylamino-6-methyl-7-(o,p-dimethylanilino) fluoran and said color developing agent is p-hydroxy benzoic acid butyl ester.

10. The heat-sensitive recording sheet according to claim 1, wherein said color-forming layer includes a binder.

11. The heat-sensitive recording sheet according to claim 10 wherein said binder is polyvinyl alcohol or hydroxy-ethyl cellulose.

12. The heat-sensitive recording sheet according to claim 1, wherein said color-forming layer contains a phenol as the color developing agent in addition to p-hydroxybenzoic acid ester.

13. The heat-sensitive recording sheet according to claim 12, wherein said phenol as the color developing agent is at least one substance selected from the group consisting of p-tertiary-butylphenol, p-phenylphenol, and Novolak phenolic resin.

14. The heat-sensitive recording sheet according to claim 12, wherein said chromogenic dyestuff is 3-(N-cyclohexyl-N-methylamino)-6-methyl-7-anilinofluoran, said color developing agent is p-hydroxybenzoic acid benzyl ester and p-phenylphenol, and said phenolic substance which resists yellowing is 4,4'-butylidene-bis-(3-methyl-6-tertiary-butylphenol).

* * * * *

UNITED STATES PATENT AND TRADEMARK OFFICE

CERTIFICATE OF CORRECTION

PATENT NO. : 4,399,188

DATED : August 16, 1983

INVENTOR(S) : Yamato, et al.

It is certified that error appears in the above—identified patent and that said Letters Patent is hereby corrected as shown below:

Column 10:

Line 56, change "is" to --it--.

In the Claims:

Claim 4:

Column 14, line 38, change "(4-methyl6-tertiary-butylphenol)" to --(4-ethyl-6-tertiary-butylphenol)--.

Signed and Sealed this

First Day of May 1984

[SEAL]

Attest:

GERALD J. MOSSINGHOFF

Attesting Officer

Commissioner of Patents and Trademarks